United States Patent [19]

Eisenlohr

[11] 4,248,691

[45] Feb. 3, 1981

[54] PROCESS OF PRODUCING A SUSPENSION OF BROWN COAL AND OIL FOR HYDROGENATION

[75] Inventor: Karl-Heinz Eisenlohr, Dreieich, Fed. Rep. of Germany

[73] Assignee: Metallgesellschaft Aktiengesellschaft, Frankfurt, Fed. Rep. of Germany

[21] Appl. No.: 51,283

[22] Filed: Jun. 22, 1979

[30] Foreign Application Priority Data

Jul. 14, 1978 [DE] Fed. Rep. of Germany ..... 2831024

[51] Int. Cl.[3] ..... C10G 1/00; C10G 1/06; C10L 1/32

[52] U.S. Cl. ..... 208/8 LE; 208/10; 44/51

[58] Field of Search ..... 208/10, 8 LE; 44/51

[56] References Cited

U.S. PATENT DOCUMENTS

| | | | |
|---|---|---|---|
| 2,620,312 | 12/1952 | Monger | 44/51 |
| 3,635,814 | 1/1972 | Rieve et al. | 208/10 |
| 3,660,269 | 5/1972 | McCouley | 208/8 LE |
| 3,745,108 | 7/1973 | Schuman et al. | 208/10 |
| 3,909,390 | 9/1975 | Urfon | 208/10 |

*Primary Examiner*—Delbert E. Gantz
*Assistant Examiner*—William G. Wright
*Attorney, Agent, or Firm*—Sprung, Felfe, Horn, Lynch & Kramer

[57] ABSTRACT

A process for producing low water containing suspension of fine-grained brown coal and oil suitable for hydrogenation by hydrogen gas under pressure of 100 to 400 bars at 300° to 500° C. is described. The brown coal is dewatered by being disintegrated to particle sizes of below 5 mm, mixed with oil and subjected for at least about one minute in a first holding reactor to a temperature of 250° to 32° C. at a pressure of 25 to 120 bars. The mixture forms an oil phase and a water phase. The oil phase containing dewatered brown coal is removed from the water phase, passed to a second holding reactor and therein maintained for at least about one minute at a temperature up to 200° C. under a pressure of up to 10 bars.

Water-oil vapor in the second holding reactor is removed to leave behind low water-containing brown coal-oil suspension suitable for the hydrogenation.

12 Claims, 1 Drawing Figure

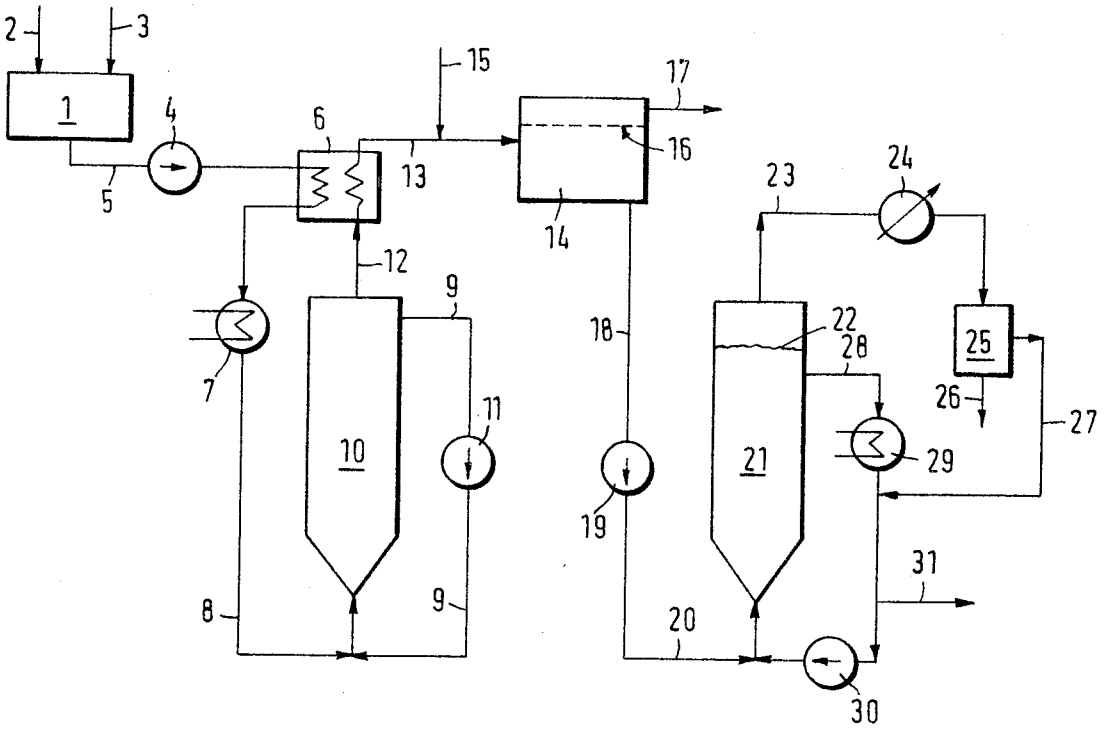
1
2
3
4
5
6
7
8
9
9
10
11
12
13
14
15
16
17
18
19
20
21
22
23
24
25
26
27
28
29
30
31

PROCESS OF PRODUCING A SUSPENSION OF BROWN COAL AND OIL FOR HYDROGENATION

BACKGROUND OF THE INVENTION

1. Field of the Invention

This invention relates to a process of producing a low-water suspension which consists mainly of fine-grained brown coal and oil and is to be hydrogenated in the presence of a high-hydrogen gas under a pressure of 100 to 400 bars and at a temperature of about 300° to 500° C.

2. Discussion of Prior Art

It is known that various coals, inclusive of brown coals, can be hydrogenated and the hydrogenated products can be processed to produce motor fuels. A detailed description of this technology has been given by W. Krönig in his book "Die katalytische Druckhydrierung von Kohlen, Teeren und Mineralölen" (1950), Springer-Verlag, Berlin-Göttingen-Heidelberg. More recent developments have been described in U.S. Pat. Nos. 3,745,108; 3,660,269; and 3,635,814. In the known processes, a catalyst is used or is not used in the hydrogenating zone. Most processes using no catalyst rely on the catalytic activity of metallic components of the coal. Coal to be hydrogenated must be very finely divided so that it presents a large surface area to the hydrogen. A catalyst which is employed must also be finely divided and must be mixed with the coal.

The hydrogenation of brown coal is adversely affected by its high water content, which is usually in the range of 35 to 70% by weight of water related to the total weight of the water-containing brown coal. That water content must be considerably reduced, below 10% by weight, before the hydrogenation.

It is an object of this invention, therefore, to provide a process for the preparation of a brown coal-oil suspension where the brown coal has a reduced water content and can be readily employed in reactions with hydrogen. It is a further object of this invention, therefore, to provide a simple and efficient method for the reduction of the water content of brown coal-oil suspensions.

SUMMARY OF THE INVENTION

The foregoing objects are provided in accordance with this invention which provides a process for the production of a brown coal-oil suspension having a low water content, which process comprises:

A. Disintegrating water containing brown coal to a particle size of below 5 mm and mixing the same with oil;

B. Introducing the resultant mixture to a first holding reactor and maintaining the same therein for at least about one minute at a temperature of 250° to 320° C. under a pressure of 25 to 120 bars;

C. Removing at least a portion of the mixture from the first holding reactor and feeding the same at a temperature of 30° to 200° C. to a phase-separating zone whereby said mixture forms a coal-oil phase and a water phase;

D. Withdrawing said coal-oil phase from said phase-separating zone and introducing it to a second holding reactor;

E. Maintaining said coal-oil phase in said second holding reactor for at least about one minute at a temperature of up to 200° C. under a pressure of up to 10 bars;

F. Withdrawing from said second holding reactor a water-oil vapor mixture, and

G. Recovering a low-water brown coal-oil suspension suitable for hydrogenation.

When the brown coal-oil mixture is treated at high temperatures and under high pressure, the brown coal releases water. For a high efficiency of the process, the pressure and temperature in the first holding reactor must be controlled so that no water or only little water is evaporated. A formation of steam would involve a consumption of energy and that consumption should be minimized.

Before the treatment the brown coal is suitably disintegrated to particle sizes below 2 mm because this will promote the release of water from the coal particles. The oil which is to be mixed with the disintegrated brown coal may contain phenols in a proportion of 2 to 30% by weight, preferably at least 10% by weight. That phenol-containing oil is suitably derived from products obtained by the hydrogenation or dry distillation or gasification of brown coal. An oil having under atmospheric pressure a boiling range from above 200° C. to about 500° C. is preferably used to form the brown coal-oil mixture. It is important that the density of the coal-oil suspension after the first holding reactor be different from and, e.g., higher than the density of water under the same conditions.

The conditions in the second holding reactor are preferably controlled so that a space which contains water vapor is provided above a liquid surface. That water vapor can be withdrawn continuously. For this purpose a pressure below 1 bar is maintained in the reactor.

BRIEF DESCRIPTION OF DRAWING

An embodiment of the process according to the invention will be explained with reference to the drawing, which is a flow scheme of the process.

DESCRIPTION OF SPECIFIC EMBODIMENT

A disintegrator 1 is fed with water-containing, granular brown coal in duct 2 and with oil in conduit 3. Generally, the weight ratio of brown coal to oil in the disintegrator is 2 to 0.5:1, preferably 1.5 to 1:1. In the disintegrator the brown coal is disintegrated to particle sizes below 5 mm, preferably below 2 mm, and is mixed with oil at the same time. The mixture is withdrawn from the disintegrator 1 in conduit 3 by means of a pump 4 and is heated in a heat exchanger 6. In a specific embodiment, the heat exchange may be effected by a separate medium, such as heat transfer oil. In that case the solids-containing suspension need not be passed through the shell space of the heat exchangers.

The brown coal-oil mixture is heated to temperatures of 250° to about 320° C. in a heater 7. The heated mixture and recycled material from conduit 9 are fed in conduit 8 to the lower part of a first holding reactor 10. In the holding reactor 10, the mixture is kept in agitation for at least about 1 minute at temperatures of 250° to 320° C. A pressure of 25 to 150 bars is maintained in the reactor 10. Under these conditions, water is released by the brown coal in a process which may be described as rapid carbonization. In the first holding reactor 10, the pressure and temperature are controlled so that the released water remains liquid and virtually no vapor phase is formed.

The required agitation can be imparted to the mixture in the holding reactor 10, e.g., by mixers, not shown, or in that the mixture is circulated by a pump. It may be sufficient to withdraw part of the content of the reactor 10 at the top end in conduit 9 by means of a pump 11 and to feed the withdrawn mixture to the reactor at its lower end together with fresh mixture, as is shown on the drawing.

Part of the content of the reactor 10 is withdrawn and is first supplied in conduit 12 to the heat exchanger 6. The mixture of brown coal, oil and water is cooled to temperatures of 60° to 200° C., e.g., 60° to 90° C., by the heat exchange and is fed in conduit 13 to a phase-separating zone 14. Additional oil can optionally be fed in conduit 15 to the mixture before it reaches the zone 14.

The temperatures in the phase-separating zone lie preferably in the range of 50° to 150° C.

An interface 16 between the brown coal-oil mixture and the supernatant water is formed in the phase-separating zone 14. The water is withdrawn in conduit 17 and can be subjected to a utilization of waste heat. The waste heat may be used, e.g., to heat the mixture withdrawn from the disintegrator 1.

A partly dewatered brown coal-oil mixture is withdrawn from the phase-separating zone 14 in conduit 18 by means of a pump 19 and is fed in conduit 20 to a second holding reactor 21. In the reactor 21, the material is kept in agitation for at least 1 minute under a pressure of at most about 10 bars, preferably 1 to 8 bars. This may also be accomplished in that the mixture is circulated at a temperature in the reactor 21 which exceeds the boiling point of the water under the existing pressure. In most case, it does not exceed 200° C. Preferably, the temperature is 110° to 180° C.

A liquid surface 22 is formed in the second holding reactor 21. A vapor space is disposed over the liquid surface. The evaporation desirably involves a disintegration of the coal particles so that new surfaces are formed. The vapor is withdrawn in conduit 23 and cooled in a condenser 24. The condensates separate in a succeeding separator 25, from which water and oil are separately withdrawn in conduits 26 and 27, respectively.

Part of the mixture is withdrawn in conduit 28 from the second holding reactor 21 and is first fed to a heater. Oil from conduit 27 is added to the heated mixture of brown coal and oil. A first partial stream of the mixture is recycled to the reactor 21 by means of a pump 30. The second partial stream is withdrawn in conduit 31 and is available for hydrogenation. The low-water brown coal-oil suspension which has now been obtained contains the two components in a weight ratio of preferably 1:1 to 1:2. The hydrogenation is effected in a pressure range of 100 to 400 bars and at temperatures of about 300° to 500° C., and can be effected by a process in which a catalyst is used or is not used.

In order to more fully illustrate the nature of the invention and the manner of practicing the same, the following example is presented:

EXAMPLE

In a test installation which was similar to that shown on the drawing but somewhat simplified, 5000 grams of pit-wet brown coal, which was in the form of coarse lumps and had the following properties:

Lump density—1182 g/1000 ml
Water content—55.0% by weight
Ash—2.3% by weight were mixed with 3200 grams of an oil fraction which had been obtained by the sump phase hydrogenation of the brown coal feedstock. The oil fraction had the following properties:

Boiling range—200° to 320° C.
Relative density at 20° C.(based on water)—0.990
Acid oils—25.0% by volume.

The oil-coal mixture was ground to a coal particle size below 1 mm.

The mixture of oil and disintegrated brown coal was then transferred to a reactor 10, consisting of an autoclave, and was slowly heated therein. When the mixture was at a temperature of 95° C., the autoclave was closed and the mixture was slowly heated to 300° C. and constantly stirred. A pressure of 120 bars was thus obtained.

The temperature of 300° C. was maintained for 30 minutes. Thereafter, the external heating was discontinued. The autoclave cooled down slowly. The operation of the stirrer was discontinued at about 120° C. When an equalization of pressure had been effected at 95° C., the contents of the autoclave were transferred to a settling vessel 14, in which two layers formed at 60° C. The upper layer, which contained water and some phenols, was separated. This amounted to 1400 grams or 52% by weight of the water content of the pit-wet coal.

The partly dewatered brown coal and the oil were then jointly transferred to a distillation unit (reactor 21) and heated with stirring. At a head temperature of 95° C., an azeotropic mixture was vaporized, which consisted of 80% by volume of water and 20% by volume of oil. The azeotropic condensate was separated and the oil was refluxed to the distillation unit.

As more water was extracted from the brown coal-oil mixture, the water content of the oil-water distillate leaving the distillation unit increased and the head temperature increased.

When 1230 grams of water had been removed, the distillation was discontinued and the brown coal-oil mixture was cooled down. The water content of the dewatered brown coal was ascertained as 4.2% by weight.

The dried brown coal suspended in oil is further disintegrated before being hydrogenated in the sump phase.

I claim:

1. A process for producing a low water suspension of fine-grained brown coal and oil which comprises:

(a) disintegrating brown coal having a water content of 35 to 70 percent by weight to a particle size of below 5 mm and mixing the same with oil at a weight ratio of 0.5 to 2:1;

(b) introducing the resultant mixture to a first holding reactor and maintaining the same therein under agitation for at least about one minute at a temperature of 230° to 320° C. under a pressure of 25 to 120 bars;

(c) removing at least a portion of the mixture from the first holding reactor and feeding the same at a temperature of 30° to 200° C. to a phase-separating zone whereby said mixture forms a brown coal-oil phase and a water phase, and withdrawing said water phase;

(d) withdrawing said brown coal-oil phase from said phase-separating zone and introducing it to a second holding reactor;

(e) maintaining said brown coal-oil phase in said second holding reactor for at least about one minute under agitation at a temperature of up to 200° C.

under a pressure of up to 10 bars whereby a low-water brown coal-oil suspension and a vaporous water-oil mixture is formed therein; and (f) from said second holding reactor withdrawing said vaporous water-oil mixture and separately withdrawing said low-water brown coal-oil suspension suitable for hydrogenation, the water content of the brown coal of said suspension being below 10 percent by weight.

2. A process according to claim 1 wherein said mixture is continuously withdrawn from said first holding reactor.

3. A process according to claim 1 wherein oil is added to said mixture from said first holding reactor prior to introduction of said mixture into said phase-separating zone.

4. A process according to claim 1 wherein the temperature and pressure maintained in said first holding reactor are such that substantially no water evaporates.

5. A process according to claim 1 wherein said brown coal is disintegrated to a particle size below 2 mm.

6. A process according to claim 1 wherein a pressure below 1 bar is maintained in the second holding reactor.

7. A process according to claim 1 wherein the low water suspension of brown coal and oil formed in the second holding reactor contains the two components in a weight ratio of 1:1–2.

8. A process according to claim 1 wherein the temperature in the phase-separating zone lies in the range of 50° to 150° C.

9. A process according to claim 1 wherein a water phase is removed from said phase-separating zone and the water is employed in indirect heat exchange to heat a brown coal-oil mixture en route to said first holding reactor.

10. A process according to claim 3 wherein oil which is mixed with disintegrated brown coal contains phenols and said oil is mixed in a proportion of 2 to 30% by weight.

11. A process according to claim 10 wherein the amount of oil added to the disintegrated brown coal mixture en route to the phase separator is 10 to 30% by weight based upon the weight of the brown coal-containing mixture from said first holding reactor.

12. A process according to claim 10 wherein said oil added to the disintegrated brown oil is derived from products of hydrogenation.

* * * * *